US005702177A

United States Patent [19]

Lin

[11] Patent Number: 5,702,177

[45] Date of Patent: Dec. 30, 1997

[54] ORBITAL LAMP

[76] Inventor: Ching-Yuan Lin, No. 8, Lane 30, Su Wei Road, Wu Ku Hsiang, Taipei Hsien, Taiwan

[21] Appl. No.: 620,552

[22] Filed: Mar. 25, 1996

[51] Int. Cl.[6] ..... H01R 25/14

[52] U.S. Cl. ..... 362/226; 362/370; 362/382; 439/118

[58] Field of Search ..... 362/226, 271, 362/368, 370, 432, 457, 382; 439/110, 116, 117, 118, 119, 120, 121

[56] References Cited

U.S. PATENT DOCUMENTS

| | | | |
|---|---|---|---|
| 3,813,633 | 5/1974 | Clement | 439/118 |
| 3,894,781 | 7/1975 | Donato | 439/121 |
| 4,776,809 | 10/1988 | Hall | 439/121 |
| 5,128,847 | 7/1992 | Lin et al. | 362/226 |

*Primary Examiner*—Alan Cariaso
*Attorney, Agent, or Firm*—Pro-Techtor International

[57] ABSTRACT

The object of the invention is to provide an improved orbital lamp with easy, inexpensive and safe installation comprising one top lid having one semi-circled opening on its back in corresponding to the opening on the lid top on the bottom lid. Said top lid has one L-shaped opening on its top extending to its side for the moving rod to move therein. Said top lid has one arc-shaped protrusion block on its front end. Said movable pivot has two protrusion rings with proper distance in the between to be set into the opening on the supporting plate on the bottom lid. Said movable pivot has one inlaid fastening plate stretching out of the lid top on the bottom lid to inlay into the moving trough on the orbital strip through the movement of the moving rod. The flat long strip protruded poles on the bottom lid may fit into the the through holes on the top lid making the connection of the top lid and the bottom lid tight and firm. The two protruded beads on the diameter of the top board on the supporting pivot connected to the end of the lamp shade may slide into the two shallow indentations on the arc-shaped protrusion block having one through hole for the top board to pass through for fastening the lamp fixture.

3 Claims, 10 Drawing Sheets

172
174
173
171
17

165

14
141
1411
142
15
154
153
158
157
156
159
155
151
152
165
1631
168
163
166
162
161
1611
16
164
167
146
145
144
142
143
146

122
122
121
135
132
131
133
134
13
123
135
12
11
112
113

135
131
134

124
125
121
122

ORBITAL LAMP

BACKGROUND OF THE INVENTION

As shown in FIG. 1 is the conventional orbital lamp comprising two hanging rods 1 both being electric conductors having depressed voltage and being fixed by two rod fixtures 21 being passed through by two lamp fixing rods 2 hrough the round holes 22 thereon, both the two indented troughs 24 located on the same side of the two rod fixtures 21 having the indented arc-shaped opening to be inlaid by the hanging rods 1 which is fastened by the lamp fixing rods 2 by screwing two screws 26 into the two thread holes 25 located on the same side of both rod fixtures 21.

The conventional orbital lamp can slide up and down on the orbit to adjust its height. There are certain defects existing in the conventional orbital lamp listed as follows:

1. The two hanging rods 1 are electric conductors having depressed voltage and fixed by two lamp fixtures 2 which are screwed on said hanging rods 1 throught the rod fixtures 21. If someone turns on the electricity supply without notifying the one who is installing the device, the latter may be struck by the electricity flew over the hanging rods and get hurt or even killed. If the hanging rods fell during the electricity flowing, those who stand below may be injured by the electric shock.
2. The installation of the conventional orbital lamp takes much space, time and cost. The process of installation is also complicated and difficult. Both the two rod fixtures 21 have the round holes 22 being passed through by the lamp fixing rods 2. The two indented troughs 24 on the two rod fixtures 21 are riding on the two hanging rods 1 and fastened by the screws 26. These fastening has to be by pairs increasing the cost.

SUMMARY OF THE INVENTION

The present invention is to provide an improved orbital lamp which is easily and safely installed. The inlaid fastening plate on the movable pivot can be clipped on the moving trough on the orbital strip through the movement of the moving rod. The process of installation is much easier and convenient than the conventional orbital lamp and saves space, time and money.

BRIEF DESCRIPTION OF THE DRAWINGS

FIG. 7A is a diagram showing the inside of the front of the top lid of FIG. 7;

FIG. 7B is a diagram showing part of the back of the top lid of FIG. 7;

FIG. 7C is a diagram showing the enlarged I-shaped pressing block of FIG. 7;

FIG. 7D is a diagram showing the enlarged indentation stripes of FIG. 7;

DETAILED DESCRIPTION OF THE PREFERRED EMBODIMENT

Figure 1:
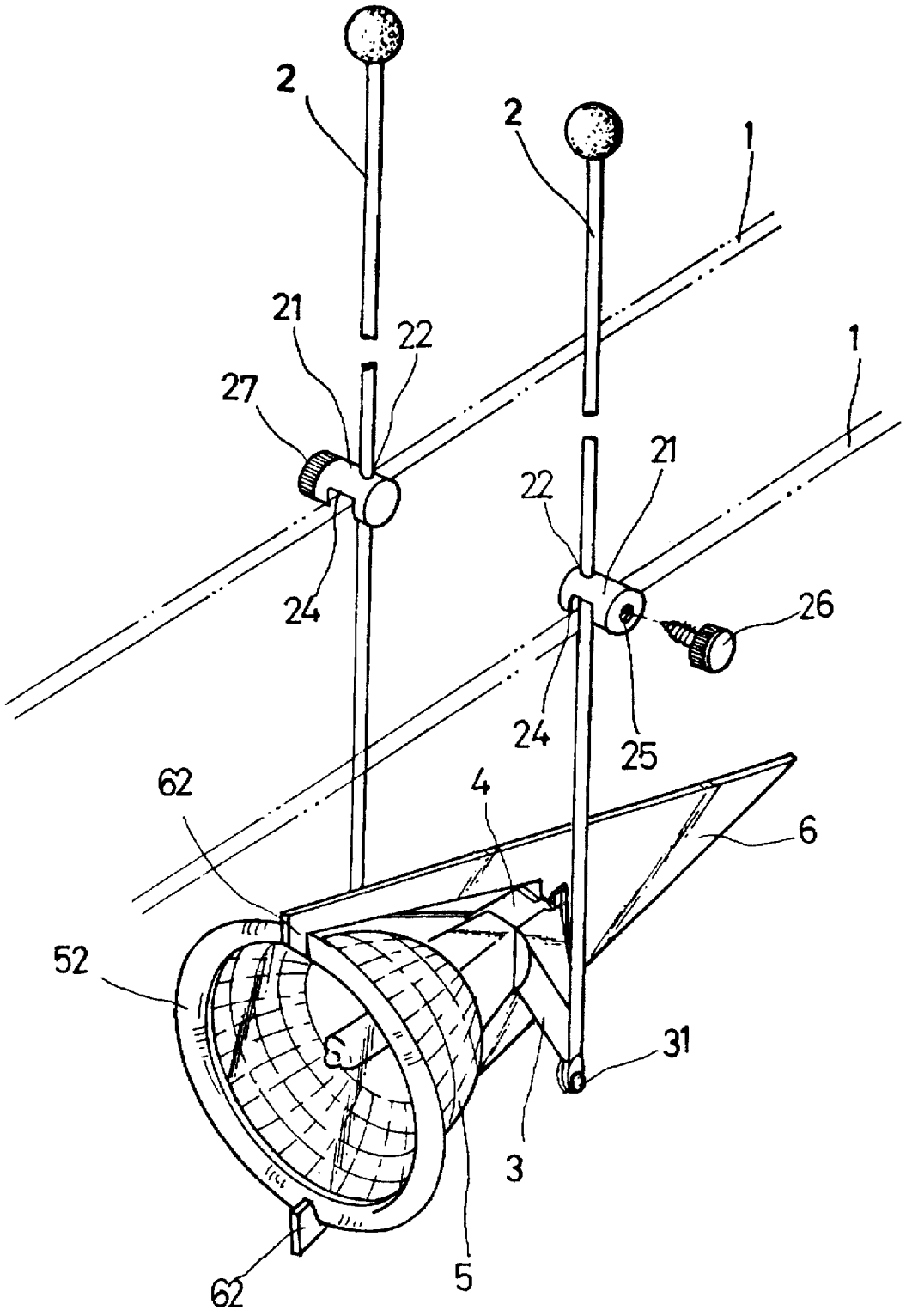
FIG. 1 PRIOR ART
FIG. 1 is a diagram showing the conventional orbital lamp.
Figures 2, 2A, 2B, 2C, 2D, 2E:
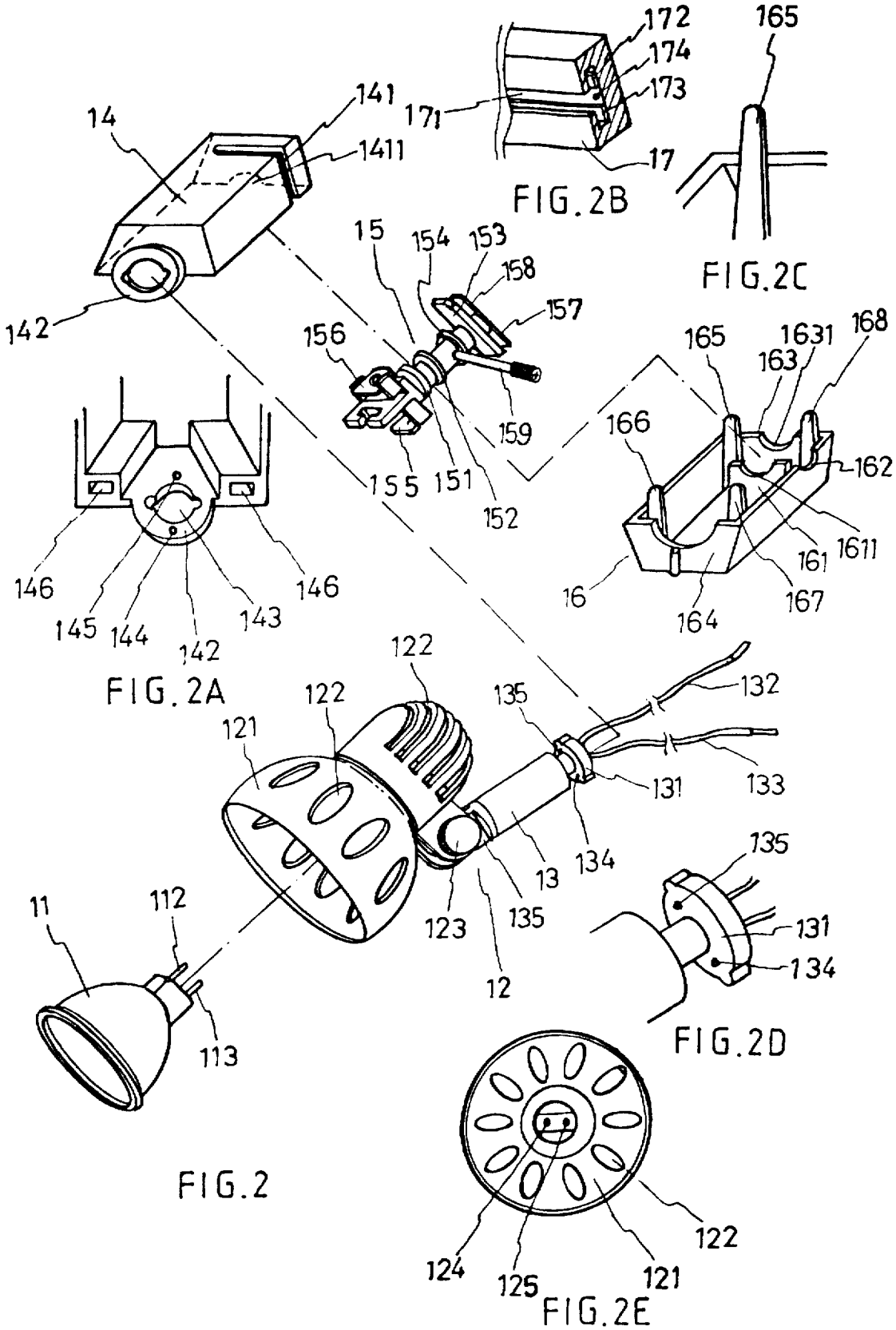
FIG. 2 is a diagram showing part of the present invention in dissambled mode.
FIG. 2A is a diagram showing part of the inside of the top lid.
FIG. 2B is a diagram showing part of the orbital strip.
FIG. 2C is a diagram showing the enlarged long strip protruded pole.
FIG. 2D is a diagram showing the enlarged top board.
FIG. 2E is a diagram showing the front view inside the lamp shade.

Referring to FIG. 2, the present invention comprises one top lid 14, one movable pivot 15, one bottom lid 16, one lamp fixture 12, one lamp body 11, one orbital strip 17, wherein said top lid 14 having one semi-circled opening 1411 on its back in corresponding to the opening 1631 on the bottom lid 16 and having one L-shaped opening 141 on its top extending to its side for the moving rod 159 on the movable pivot 15 to move therein. Referring to FIG. 2A which shows the inside of the top lid 14, one arc-shaped protrusion block 142 locates on the front end of said top lid 14 with two shallow indentions 144 and 145 between which located one through hole 143 thereon. Said top lid 14 has four through holes 146 in corresponding to the protruded poles 165, 166, 167 and 168 on the bottom lid 16.

Said movable pivot 15 has two electric conducting slices 157 and 158 which are integrally molded in separate with the screwed fastening plates 155 and 156 thereon. Two protrusion rings 151 and 152 locate on the movable pivot 15 with proper distance in the between fastening the moving rod 159. Said movable pivot 15 has one inlaid fastening plate 153 on its back and one protrusion ring 154 on its rear end.

One supporting plate 161 with one semi-circled opening 1611 thereon locates inside said bottom lid 16 which has four protruded poles 165, 166, 167 and 168 in corresponding to the indented holes 146 on the top lid 14. Referring to FIG. 2C, the protruded pole 165 is enlarged for better understanding.

The angle of elevation of said lamp body 11 can be adjusted by the revolving connector 135 fastened by the fastening screw 123 on the lamp shade 121 on the lamp fixture 12. Said revolving connector 135 is wrapped inside the supporting pivot 13 to revolve for adjusting the angle of elevation of said lamp body 11. The structure and technique of the connection of the revolving connector 135 and the supporting pivot 13 is omitted for being common.

Said lamp shade 121 has several through holes 122 on its back and its surrounded side to dissipate the heat of the lamp body 11. Said lamp shade 121 has two internal receptacles 124 and 125 and two electric cords 132 and 133 on its inner side as shown in FIG. 2E.

Said supporting pivot 13 is a hollow cylindrical pivot having an attaching fixture 131 on its rear end. Said attaching fixture 131 has two protruded beads 134 and 135 on its diameter as shown in FIG. 2D which is enlarged for better understanding.

Referring to FIG. 2B, said orbital strip 17 is a hollow C-shaped long strip having two flat long strips of electric conducting slices 172 and 173 therein for electricity supply and having a slot 171 to receive the inlaid fastening plate 153 on the movable pivot 15. Said orbital strip 17 is fastened to the place wherever needed by the screw 174.

The present invention is assembled as follows:

The part between the protrusion rings 151 and 152 on the movable pivot 15 is placed in the semi-circled opening 1611 on the supporting plate 161 on the bottom lid 16. The part between the protrusion ring 154 and the inlaid fastening plate 153 is placed in the opening 1631 on the lid top 163. The inlaid fastening plate 153 on the movable pivot 15 is stretching out of the lid top 163 on the bottom lid 16. The moving rod 159 is stretching out through the opening 162. The protruded poles 165, 166, 167 and 168 on the bottom lid 16 fit in the indented holes 146 on the top lid 14. The electric cords 132 and 133 on the lamp fixture 12 pass through the through hole 143 on the top lid 14 and then screwed on the screwed fastening plates 155 and 156 on the movable pivot 15.

Figure 3:
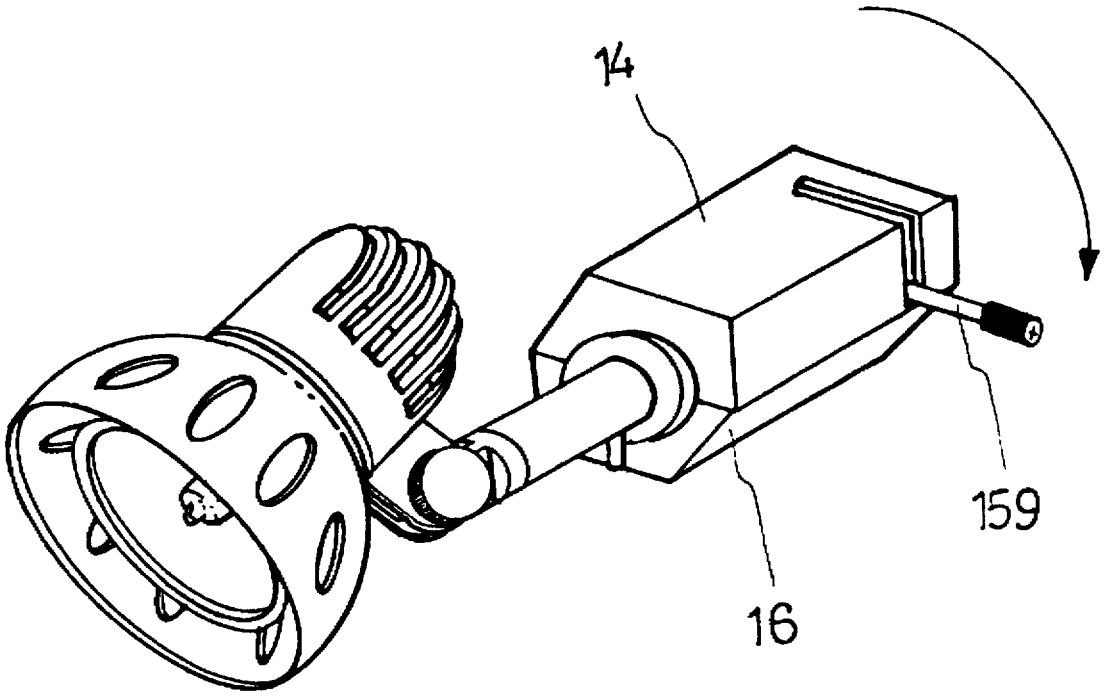
FIG. 3 is a diagram showing the part of FIG. 2 in assembled mode.
Figure 4:
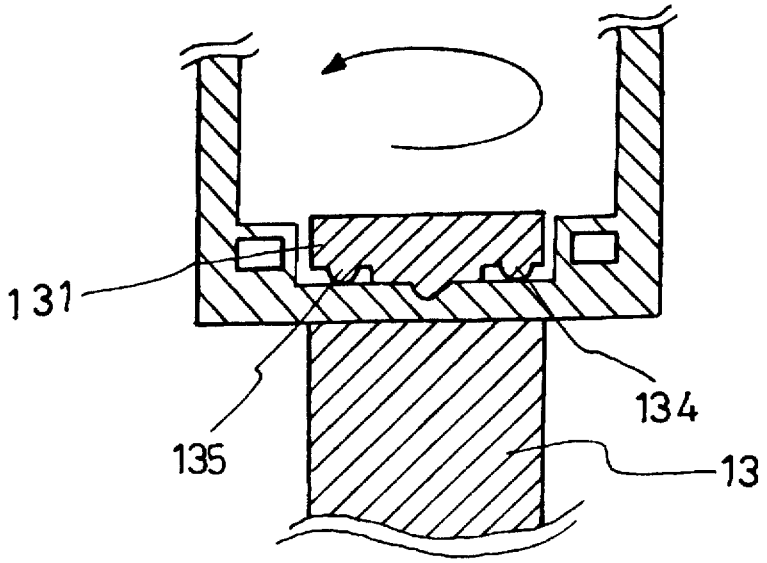
FIGS. 4 and 5 are the diagrams showing the cross section of part of the present invention in use.
Figure 5:
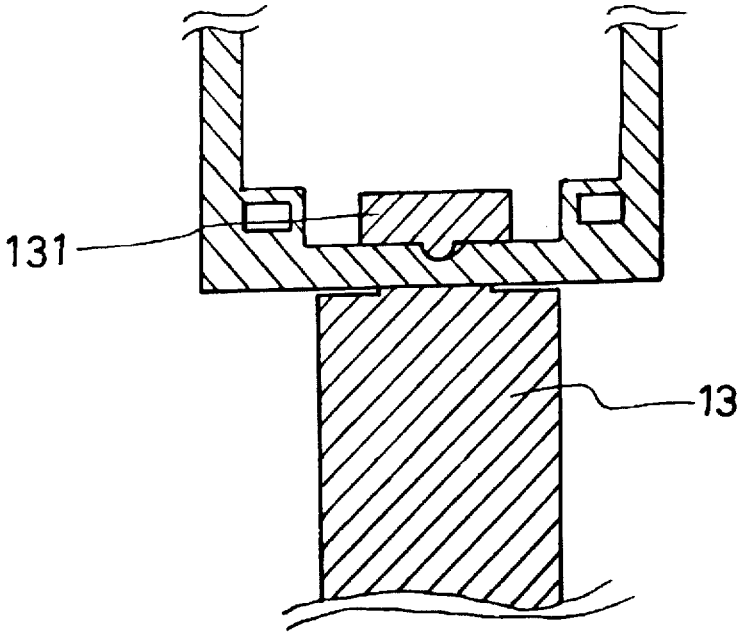

The attaching fixture 131 of the supporting pivot 13 on the lamp fixture 12 passes through the through hole 143 on the protrusion block 142 on the top lid 14. The two protruded beads 134 and 135 on the attaching fixture 131 may slide into the shallow indentations 144 and 145 by turning the attaching fixture 131 as shown in FIGS. 4 and 5. The two contact terminals 112 and 113 on the lamp body 11 are plugged in the two internal receptacles 124 and 125. The top lid 14 and the bottom lid 16 are connected together as shown in FIG. 3.

Figure 6:
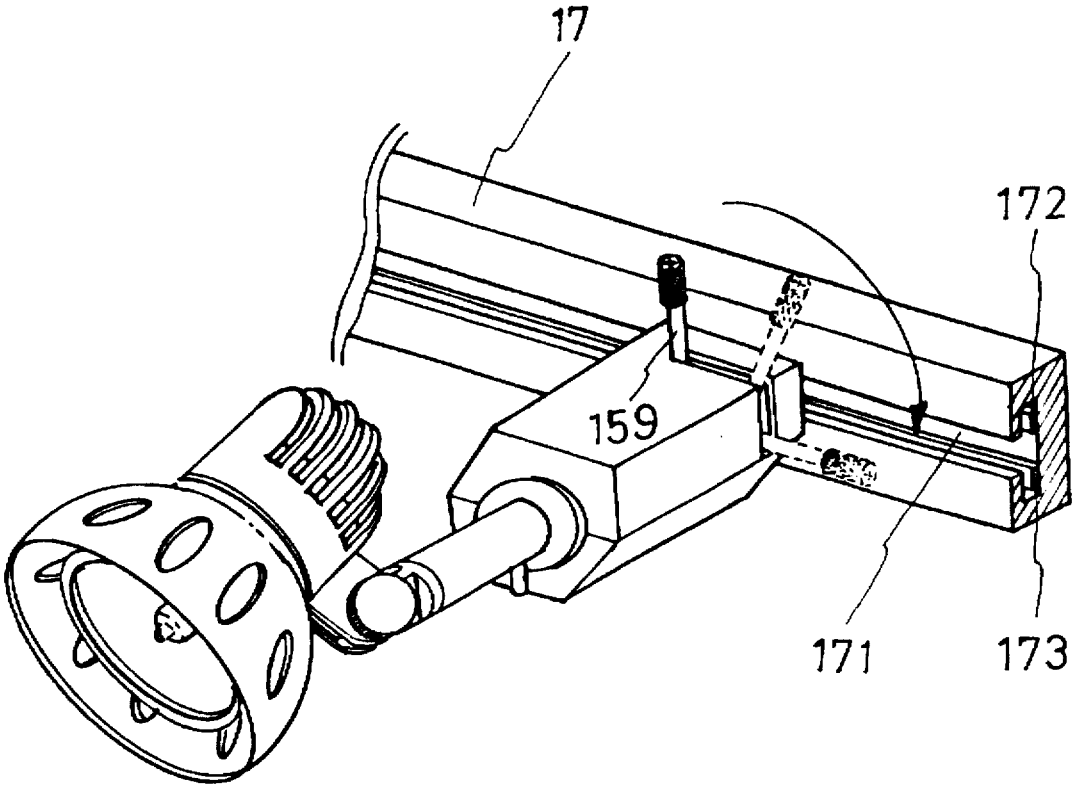
FIG. 6 is a diagram showing the present invention in use.

Referring to FIG. 6, the inlaid fastening plate 153 of said movable pivot 15 can lay vertically into the moving trough 171 on the orbital strip 17 and be fastened thereon by the movement of the moving rod 159. The electric conducting slices 157 and 158 on the movable pivot 15 may connect to the long strip of electric conducting slices 172 and 173 to gain the electricity supply, therefore, the present invention is easily and promptly installed with great safety to exclude the danger of electric shock during the installation of the conventional orbital lamp.

Figure 7:
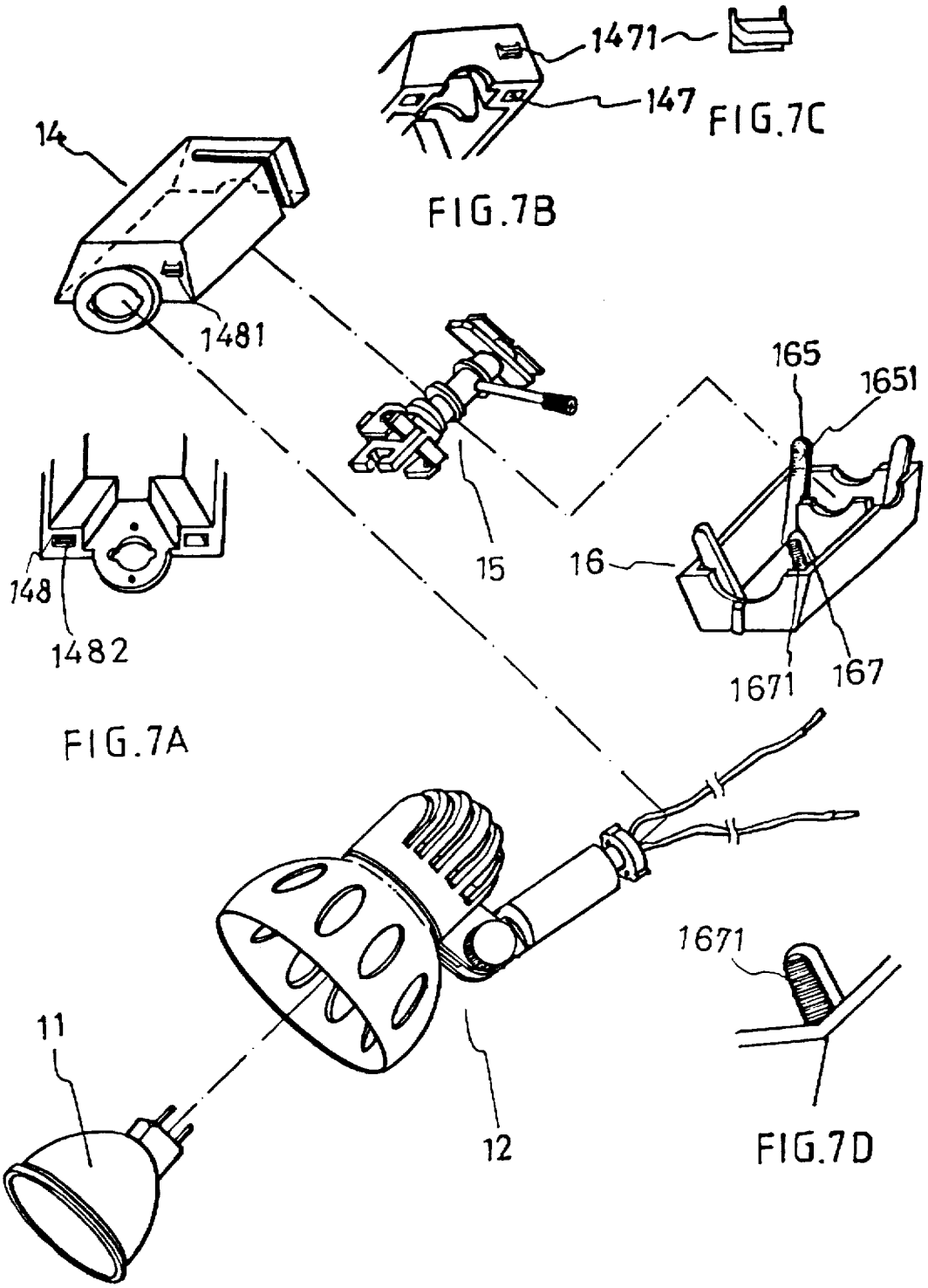
FIG. 7 is a diagram showing the cross section of another embodiment of the present invention in dissembled mode.
Figure 8:
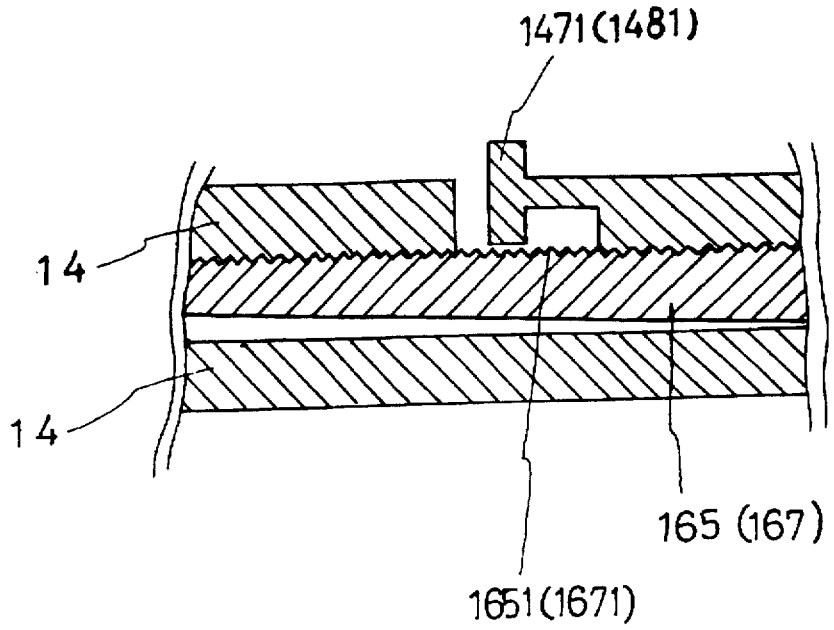
FIGS. 8 and 9 are diagrams showing the cross section of part of another enbodiment of the present invention in assembled mode in use.
Figure 9:
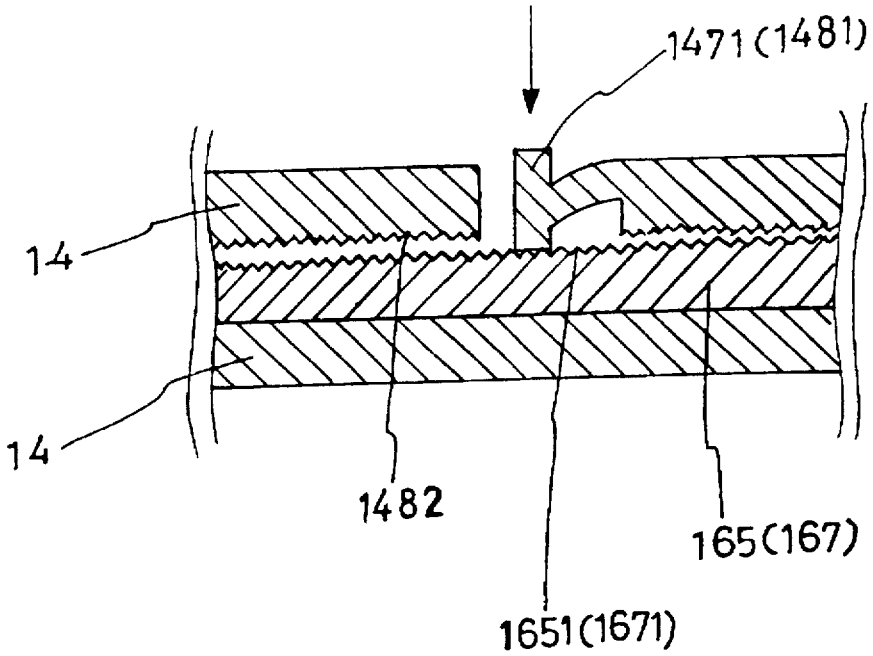

Referring to FIG. 7, the flat long strip protruded poles on the bottom lid 16 in the present invention may be slightly slanted. Set the indentation stripes 1651 and 1671 on the outward side of the protruded poles 165 and 167 located at diagonally opposite corner. Set the indentation stripe 1482 inside the indented holes 147 and 148 located at diagonally opposite corner of the top lid 14 and set one I-shaped pressing blocks 1471 and 1481 at the proper position. When the top lid 14 and the bottom lid 16 are connected together, the slanted protruded poles 165, 166, 167 and 168 have the elastic force in the reverse direction to push upwardly against the top as shown in FIG. 8. The indentation stripes 1651 and 1671 on the protruded poles 165 and 167 on the bottom lid 16 may fit in the indentation stripes inside the indented holes 147 and 148 on the top lid 14 making the connection of said top lid 14 and said bottom lid 16 tight and firm.

Said top lid 14 and said bottom lid 16 may be separated by pressing the two I-shaped pressing blocks 1471 and 1481 breaking up the connection of the indentation stripes inside the indented holes 147 and 148 and the indentation stripes 1651 and 1671 on the protruded poles 165 and 167, then the bottom lid 16 may be pulled out to break up the connection. The electric cords 132 and 133 may be easily screwed on or off the movable pivot 13.

Figures 10, 10A, 10B, 10C:
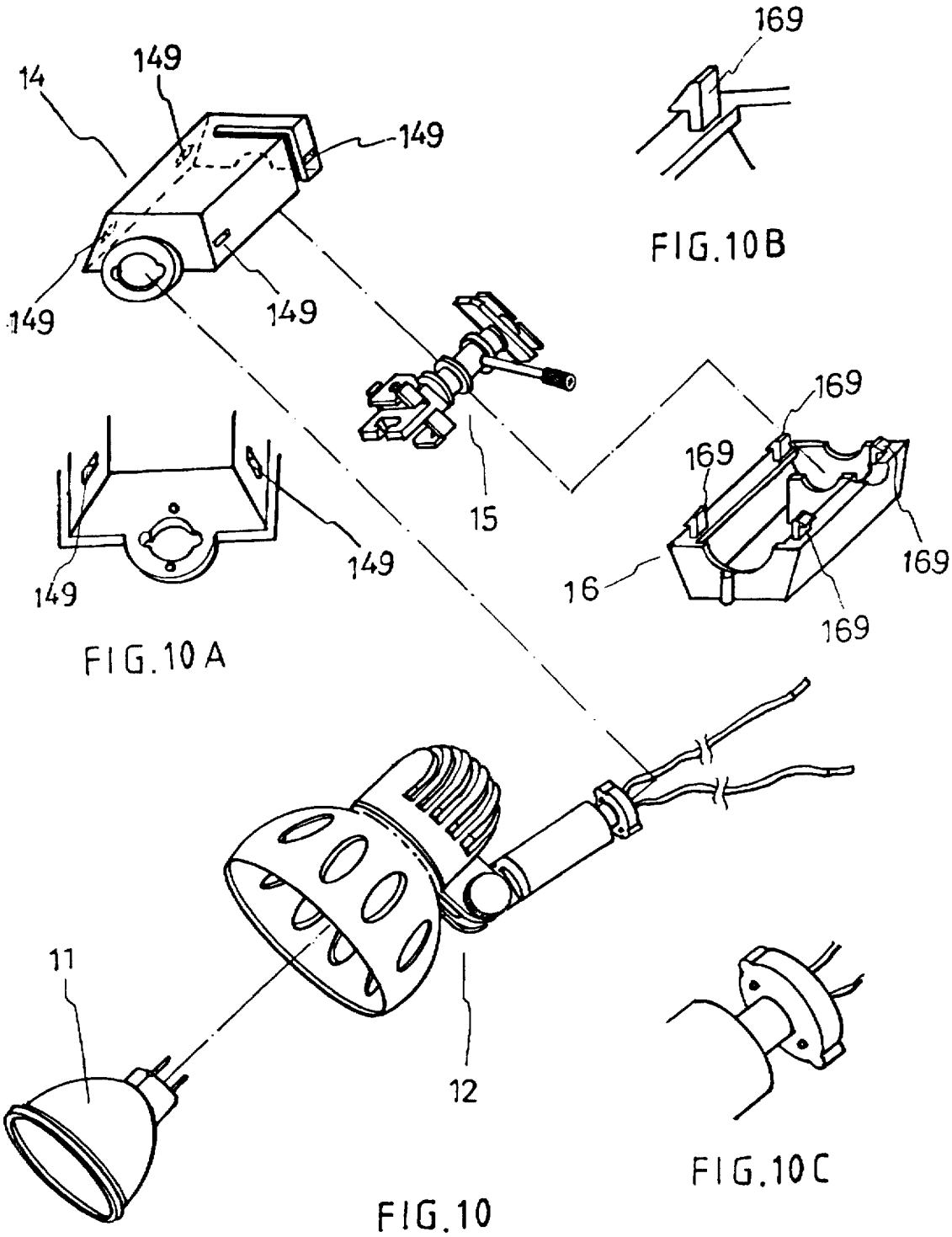
FIG. 10 is a diagram showing another embodiment of the present invention in disassembled mode.
FIG. 10A is a diagram showing the inside of the front of the top lid of FIG. 10.
FIG. 10B is a diagram showing the enlarged inverse hook body of FIG. 10.
FIG. 10C is a diagram showing the enlarged top board of FIG. 10.
Figure 11:
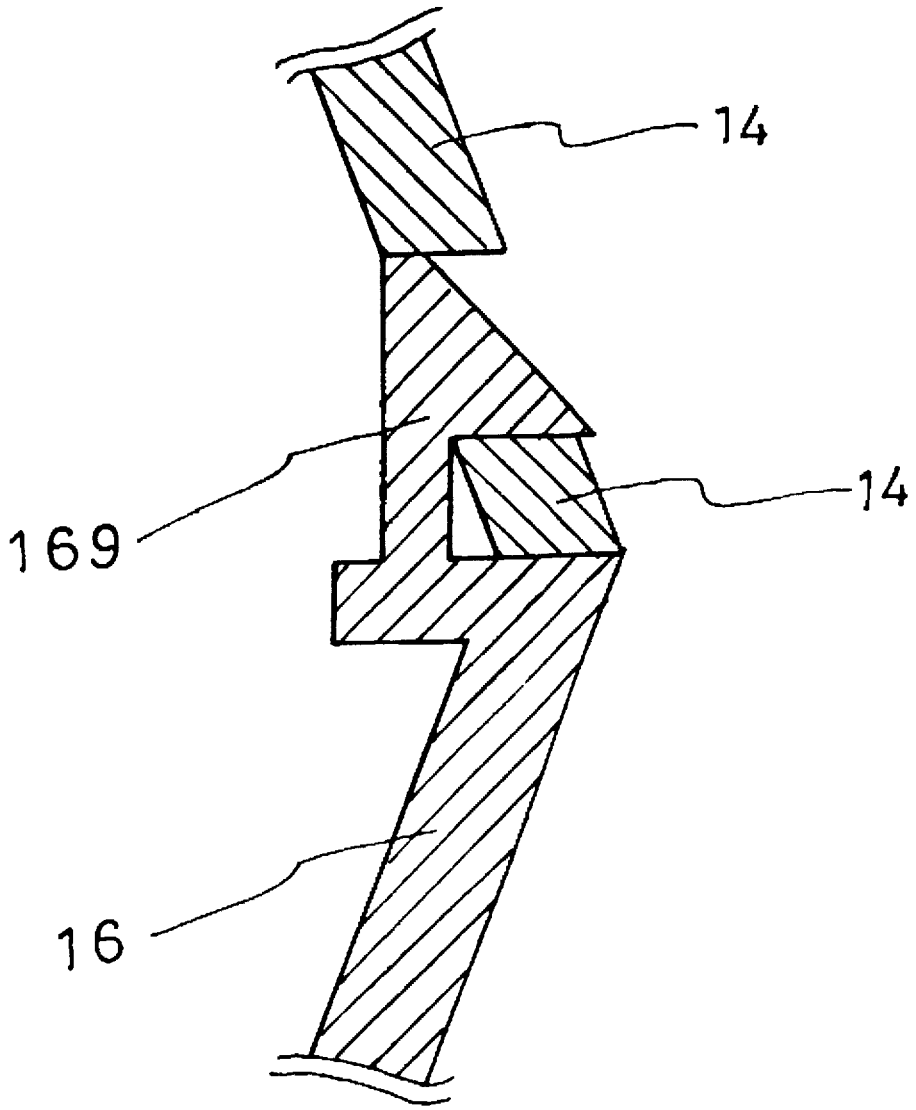
FIG. 11 is a diagram showing part of another embodiment of the present invention in assembled mode.
Figures 12, 12A:
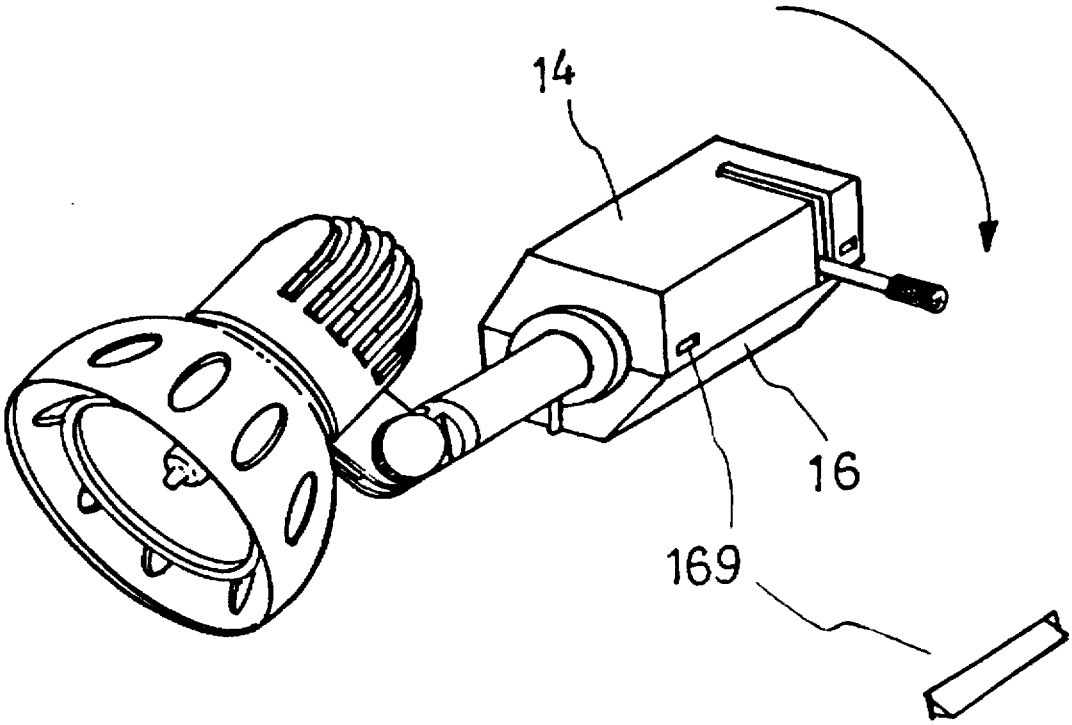
FIG. 12 is a diagram showing another embodiment of the present invention in use.
FIG. 12A is a diagram showing the enlarged inverse hook body being hooked in the through hole of FIG. 12.

Referring to FIG. 10, the top lid 14 has four side through holes 149 as shown in FIG. 10A which shows the inside of the top lid 14 on both its sides for the inverse hook bodies 169 as shown in FIG. 10B which is enlarged for better understanding on the bottom lid 16 to hook in after the top lid 14 and the bottom lid 16 connected together tightly and firmly as shown in FIGS. 11 and 12. Two inverse hook bodies 169 on different sides of the bottom lid 16 can be pressed down to seprate part of the top lid 14 from the bottom lid 16, then the rest two inverse hook bodies 169 can be pressed down to seprate the whole top lid 14 from the bottom lid 16, thus the electric cords may be easily screwed on or off the movable pivot 15.

The comparison between the conventional orbital lamp and the present invention are listed as follows for better understanding:

The disadvantages of the conventional orbital lamp are:

1. The installation is difficult.
2. The installation occupies great space.
3. The space occupied is wasted.
4. It is very dangerous.
5. It is very expensive.
6. It is not practical in use.

The advantages of the present invention are:

1. The installation is convenient.
2. The installation is easy and quick.
3. The installation occupies little space.
4. It is very safe.
5. It is not expensive.
6. It is practical in use.

What is claimed is:

1. An orbital lamp comprising:

a top lid, a movable pivot, a bottom lid, a lamp fixture, a lamp body, and an orbital strip, wherein said lamp body includes contact terminals that are received in internal receptacles of said lamp fixture, said orbital strip includes a slot in a central area thereof, said slot includes a pair of electrically conductive strips therein;

said top lid includes a semi-circular opening on a rear side thereof which corresponds in location to a semi-circular opening on a rear side of said bottom lid, said top lid further includes an opening to receive a moving rod of said movable pivot, said top lid further includes a protrusion block with a through hole therein, and said top lid includes openings to receive protruding poles of said bottom lid, said bottom lid includes a supporting plate with a semi-circular opening on a top side thereof;

said movable pivot has a pair of electrically conductive slices and a pair of fastening plates, said movable pivot includes two protrusion rings spaced so as to fix said movable pivot in position on said supporting plate, said moving rod is affixed to said movable pivot, said movable pivot further includes an inlaid fastening plate on a rear end of said movable pivot, said inlaid fastening plate is inserted into said slot on said orbital strip, said movable pivot is rotated by said moving rod to affix said inlaid fastening plate in said slot of said orbital strip.

2. The orbital lamp of claim 1 wherein:

said lamp fixture includes an attaching fixture on a rear end thereof, said top board includes protrusions thereon, said protrusions are received in indentations on an inner surface of said protrusion block when said attaching fixture in inserted into said through hole of said protrusion block and said lamp fixture is rotated.

3. The orbital lamp of claim 1 wherein:

said protruding poles of said bottom lid are slanted and said openings of said top lid are slanted to correspond to said protruding poles, and said top lid includes a plurality of side through holes and said bottom lid includes a corresponding number of inverse hook bodies such that each of said inverse hook bodies is received in a corresponding one of said side through holes so that said top lid is separated from said bottom lid by pressing downward on an I-shaped pressing block on said top lid.

* * * * *